US007089861B2

(12) United States Patent
Forsthuber

(10) Patent No.: US 7,089,861 B2
(45) Date of Patent: Aug. 15, 2006

(54) HEATING ELEMENT FOR IGNITING PYROTECHNIC CHARGE

(75) Inventor: Markus Forsthuber, Oyenhausen (AT)

(73) Assignee: Hirtenberger-Schaffler Automotive Zunder Ges. m.b.H., Hirtenberg (AT)

( * ) Notice: Subject to any disclaimer, the term of this patent is extended or adjusted under 35 U.S.C. 154(b) by 0 days.

(21) Appl. No.: 10/765,457

(22) Filed: Jan. 26, 2004

(65) Prior Publication Data

US 2004/0200371 A1 Oct. 14, 2004

(30) Foreign Application Priority Data

Jan. 28, 2003 (AT) ..... A 117/2003

(51) Int. Cl.
*F42B 3/12* (2006.01)

(52) U.S. Cl. ..... 102/202.5; 102/202.9

(58) Field of Classification Search ..... 102/200, 102/202, 202.5, 202.6, 202.7, 202.8, 202.9, 102/205

See application file for complete search history.

(56) References Cited

U.S. PATENT DOCUMENTS 3,753,403 A * 8/1973 Menichelli ..... 102/202.4
4,522,665 A * 6/1985 Yates, Jr. et al. ..... 149/21
4,708,060 A 11/1987 Bickes
4,893,563 A * 1/1990 Baginski ..... 102/202.2
4,976,200 A 12/1990 Benson
6,230,624 B1 5/2001 Chatley, Jr. et al.
6,289,813 B1 9/2001 Duguet et al.
6,324,979 B1 12/2001 Troianello
6,341,562 B1 * 1/2002 Brisighella ..... 102/202.14
6,343,000 B1 * 1/2002 Yokoyama et al. ..... 361/247
6,408,758 B1 * 6/2002 Duguet ..... 102/202.2
6,666,140 B1 * 12/2003 Roller ..... 102/202.8
2002/0069780 A1 6/2002 Bos

FOREIGN PATENT DOCUMENTS

AT 405 591 1/1999
DE 2 002 016 11/1971
DE AT 405 591 B 9/1999
EP 0112254 * 6/1984

* cited by examiner

*Primary Examiner*—Peter M. Poon
*Assistant Examiner*—David Parsley
(74) *Attorney, Agent, or Firm*—Andrew Wilford

(57) ABSTRACT

A heating element for the ignition of a pyrotechnic charge, e.g. for firing an air bag, has increased stability with respect to transient pulses and electrostatic discharge as a result of a selection of this mass, specific resistance and specific heat capacity. In particular the mass is $1.0\times10^{-9}$ kg to $4.0\times10^{-9}$ kg, the specific resistance is $1\times10^{-6}$ Ω m to $2\times10^{-6}$ Ω m and the specific heat capacity is 100 W/(kg.K) to 400 W/(kg·K).

2 Claims, 1 Drawing Sheet

HEATING ELEMENT FOR IGNITING PYROTECHNIC CHARGE

FIELD OF THE INVENTION

My present invention relates to a heating element for igniting pyrotechnic charges, e.g. for the firing of the charge for expanding a so-called air bag for a motor vehicle. The invention also relates to a method of making such a heating element.

BACKGROUND OF THE INVENTION

For the high speed expansion of a so-called air bag in a motor vehicle and for other pyrotechnic purposes, it is common to provide a heating element which can serve to ignite a pyrotechnic or explosive charge. The heating element, usually in the form of strip, can comprise a base body, a structured resistance layer or strip on the base body and contact fields or pads which are applied overlappingly to the two ends of the resistance strip. These contact elements or pads allow connection of an excitation circuit to the heating body or element so that when an electrical current is passed through the latter, the resistance element will ignite the charge.

Heating elements of this type can be fabricated by applying a glass or glass ceramic by a screen printing process to a base body with subsequent drying and sintering of the applied layer. The steps are repeated until the desired total thickness is achieved. Then the resistance paste is screen-printed onto the glass or glass-ceramic layer, dried and sintered. Finally a conductive paste is applied to the resistance strip by a screen printing method and is dried and sintered.

The firm Dynamit Nobel AG has for many years made available heating elements fabricated by a thin layer technique or by sputtering as igniters for military explosives and mining charges (see DE 2020016 A1). These types of heating elements can be used for automotive applications only at additional expense for circuitry designed to protect against misfiring or other drawbacks.

The firm LifeSparc Inc. and Auburn University have developed heating elements fabricated by layering techniques (thin layer sputtering) upon semiconductor substrates (U.S. Pat. Nos. 4,798,060 and 4,976,200) which also must be protected against external influences by additional circuitry, for example, diodes included in the semiconductive substrate if they are to be useful for automotive applications.

Schaffler & Co. (Austrian patent 405591 B) have developed a heating element utilizing thick layer technology.

This system can be used to fire pyrotechnical charges without the additional circuitry referred to above but does not satisfy the specifications which have been set forth for the automotive industry with respect to electrostatic discharge (ESD) and with respect to transient pulses while maintaining requisite electrical resistances (for example 2 ohms) and ignition delay (for example at most 2 ms).

The specifications which must be satisfied for automotive purposes are for example the USCAR specification (Chrysler, General Motors and Ford) and the VW80150 specification (of Volkswagen). Apart from requirements with respect to the environment (climate change tests and mechanical loading) the electrical requirements for the heating element (or example sensitivity to ignition and resistance characteristics in eh case of false pulses), is of the greatest significance. Tests are then carried out on such igniters so that the heating elements can satisfy the requirements of the automotive industry. In particular, the sensitivity to ignition can be determined by so-called "all fire" and "no fire" tests (for example Bruceton, Logit, Run-Down).

In the "all fire" test, the igniter must fire upon the application of a constant current pulse of 1.2 A within 2 ms to a certain statistical probability. In the "no fire" test the heating element must not fire under a constant current pulse of 0.5 A over a period of 10 seconds to a certain statistical probability. When the igniter receives a false pulse as described, it should not fire. A false pulse is a predetermined quantity of energy which can have a defined duration and a predetermined repetition frequency.

For example, an ESD false pulse in accordance with the USCAR standard is the discharge of a 150 pF condenser charged to 25 kV through a charging resistance of 500 ohm through the 2 ohm igniter heating element.

An example of a transient pulse in accordance with USCAR is a current pulse of 5.3 A with a pulse duration of 4 μs (rise time=1 μs, decay time=3 μs) and a repetition rate or keying ratio of 1:1000 over 24 hours through the 2 Ω heating elements.

The problem with igniters with all of the known heating elements is that they have been able to satisfy these specifications only with additional electronics. Up to now no heating element has been developed which could be fabricated by layering technology (thick layer, thin layer or semiconductor) which has satisfied the requirements of the automotive industry without the additional expense of external circuitry in accordance with the aforementioned specifications.

OBJECTS OF THE INVENTION

It is therefore the principal object of the present invention to provide a heating element, fabricated by layering technology which can satisfy the ignition requirements of the automotive industry without additional electronic circuitry elements.

Another object of this invention is to provide an improved method of making a heating element for the purposes described which need not require external circuitry elements to satisfy the present specifications of the automotive industry for air bag igniters.

SUMMARY OF THE INVENTION

These objects are attained, in accordance with the invention with a heating element for igniting a pyrotechnic charge comprising a base body, a structured strip shaped resistance layer on the base body, and contact fields overlapping the resistance layer at ends thereof for applying a current pulse to the heating element, wherein the heating element has a mass of $1.0\times10^{-9}$ kg to $4.0\times10^{-9}$ kg, a specific resistance of $1\times10^{-6}$ Ω m to $2\times10^{-6}$ Ω m and a specific heat capacity of 100 W/(kg.K) to 400 W/(kg·K).

The most significant difference between this heating element and that of Austrian patent 405591 is that the mass is substantially greater (more than 10 times) and that the specific resistance is also significantly greater and to a still higher degree (more than 20 times). While the overall appearance of the heating element may be similar to that of this Austrian patent, because of the surprisingly higher mass and specific resistance, the temperature of the heating element does not rise to a firing level when false energy pulses may be liberated therein. The result is that the charge cannot prematurely be fired or the heating element destroyed. It is indeed surprising that such results can be obtained with the parameters recited.

Preferably the heating element has a cross sectional area of $3.5\times10^{-10}$ $m^2$ to $7.0\times10^{-10}$ $m^2$. This cross sectional area is of particular advantage where the heating element is to have the usual resistance value, for example 2 Ω.

Advantageously the resistance layer is composed of a sintered Ag/Pd resistance paste or a sintered Ag/Au/Pd resistance paste containing 30 to 50 mass % Ag and 35 to 50 mass % Pd, or a sintered Pt/W resistance paste containing 70 to 90 mass % Pt and 5 to 20 mass % W.

These materials have been found to be especially suitable for obtaining the requisite resistance value. Any additional portions of the mass can contain oxidic additives and a glass phase. The resistance paste can contain prior to sintering normally also an organic component.

It has been found to be advantageous to make the heating element such that it would conduct away too much heat. The base body should then be composed of a high-temperature-resistant glass or glass-ceramic or ceramic with a thermal conductivity of at most 2 W/(m·K).

When the base body is composed of a high temperature glass or glass ceramic and a heat value is applied, then the base body can be composed of a high-temperature-resistant glass or glass-ceramic or ceramic with a thermal conductivity of at most 3 W/(m·K) and a heat barrier is applied to the base body which is comprised of a glass or glass-ceramic layer of a thickness of 20 to 80 μm and a thermal conductivity of at most 1.5 W/(m·K).

A preferred material for the contact field is sintered silver palladium or silver platinum thick layer conductive paste with a palladium or platinum proportion between 1 and 10 mass %. The balance contains oxidic additives and a glass phase. The conductive paste can contain prior to sintering, normally also n organic compound.

The heating element of the invention is fabricated generally as described in Austrian patent 405591. However, it has been found to be advantageous to structure the resistance strip after application of the contact layer by means of a programmable layer. The term "structuring" of the strip as used here is intended to indicate that the resistance strip is trimmed, shaped and structurally modified as may be required to impart the desired resistance to the latter between the conductive pads.

Through the use of a programmable laser source it is possible to vary the structuring of each individual resistance strip so that the heating rate or energy transformation rate thereof can be individually set or adjusted independently of the steps taken to deposit the resistance strip.

The thickness of the resistance strip and its temperature can be varied to match the requirements for the glowing bridge which may be required. Previous techniques for shaping the resistance strip have used etching, by comparison with which the laser technique is significantly more flexible especially since different etching masks are not required for different shapes or thicknesses of the resistance strip.

Preferably after the individual layers have been sintered or after the structuring resistance strip, a stabilization sintering is effected at a peak temperature of 800° C. to 900° C. for 10 to 20 minutes to stabilize the heating element. Surprisingly this post sintering step increases the speed of ignition. It is possible, therefore, to provide a larger volume of the heating element, which normally would reduce the ignition velocity and thereby make the heating element less sensitive to stray electrical signals.

The heating element which results, fabricated by layer technology, satisfies the specifications of the automotive industry or an igniter without additional electronic circuitry.

SIMULATION AND TESTING

A determination of stability with respect to ESD false pulses and transition pulses in accordance with the USCAR standard can be determined from thermodynamic calculations and the subsequent numerical simulation.

Because of the analogy between the thermodynamic heat conductivity equations with the differential equations relevant to electrical conductive (telegraphic equations), the transformations of the thermodynamic parameters into electrical parameters with precise monodimensional simulation of the thermal conditions (temperature and heat quantities) can be made with time. The tests and measurements described with corresponding reference to test results from computer simulation show agreement both with respect to precision of measurement and the idealized monodimensional boundary conditions.

Comparison of a heating element according to AT 405591 B (prior art) with the heating element according to the invention (new) with respect to ESD pulse resistance according to USCAR.

Thermal relationship applicable to the heating element:

$$Q=m\cdot c_p\cdot\Delta T \text{ or } \Delta T=Q/(m\cdot c_p)$$

where Q is the supplied energy quantity in joules (ESD pulse), m=the mass of the heating element in kg, $c_p$=specific heat capacity of the heating element in W/(kg·K), and ΔT=temperature change from the introduced energy quantity in degrees C.

The geometry of the mass of the heating element is so selected that the resistance value, the "All-Fire" value and the "No-Fire" value satisfied the specifications of the automotive industry. The values of the energy delivered were calculated based upon the materials used and the following values were obtained in satisfying the requisite specifications.

"Prior art": Effective volume $5.74\times10^{-15}$ $m^3$, with specific electrical resistance of $4.3\times10^{-8}$ Ω·m.

"New": Effective volume $1.92\times10^{-13}$ $m^3$, with specific electrical resistance of $1.4\times10^{-6}$ Ω·m.

| Material | Q [J] | Mass [kg] | $c^P$ [W/(kg · K)] | ΔT [° C.] |
|---|---|---|---|---|
| Prior Art Au/Pd-Resinate | $7.48\times10^{-5}$ | $1.09\times10^{-10}$ | 129 | 5319 |
| "New" Ag/Pd-Resistance | $1.40\times10^{-4}$ | $1.92\times10^{-9}$ | 337 | 217 |

The foregoing temperature change upon application of an ESD false pulse to the heating element indicates that because of the melting point of gold (1063° C.) the prior art heating element would be destroyed. This is not only a theoretical matter but can be demonstrated in tests.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
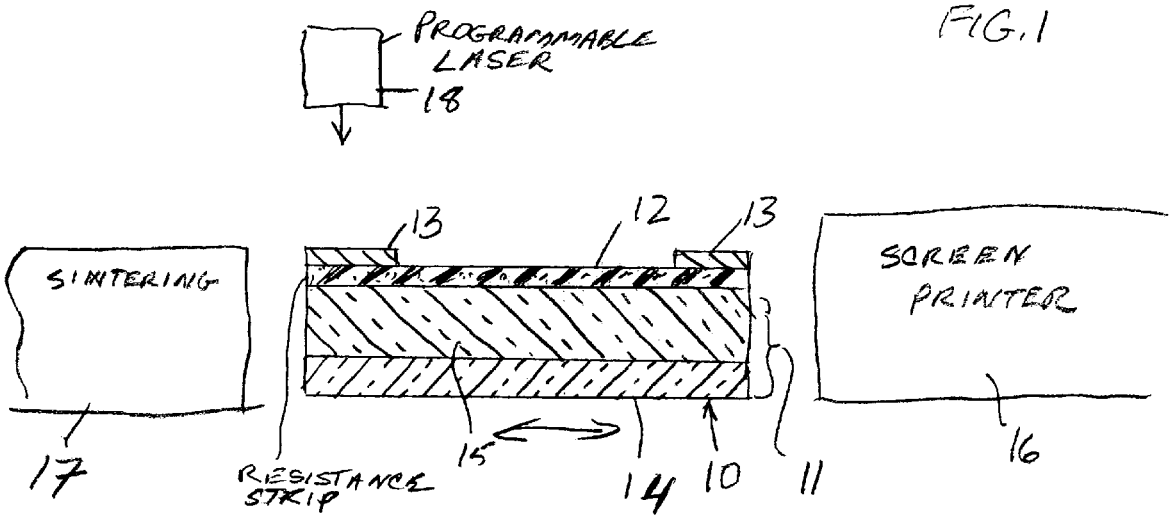
FIG. 1 is diagram illustrating the invention.

From FIG. 1, it will be seen that a heating element 10, in accordance with the invention can be built up from a base body 11 on which a resistance strip 12 is applied and by the application of contact pads or fields 13 in a layer process. In this case on the glass, glass-ceramic or ceramic layer 14, a multiplicity of screen printed glass or glass ceramic layers 15 can be applied. For this purpose a screen printer 16 and a sintering station 17 are provided. After each screen printing of a layer, that layer is subjected to sintering and the process is repeated until the full thickness of layer 15 has been produced. After the last sintering of this layer, the resistance strip, i.e. the strip which, while being conductive defines the resistance of the heating element, is applied by the screen printing of a paste onto the base body 11. That paste is then dried and sintered and the conductive pads 13 are applied to the resistance strip 12 by screen printing, drying and sintering. The entire assembly can then be subjected to an after sintering at 800° C. to 900° C. for 10 to 20 minutes. After the resistance strip 12 has been applied, it can be structured, i.e. shaped and can have its thickness controlled by a programmable laser 18 which can trim the resistance strip or burn off portions of excessive thickness.

Figure 2:
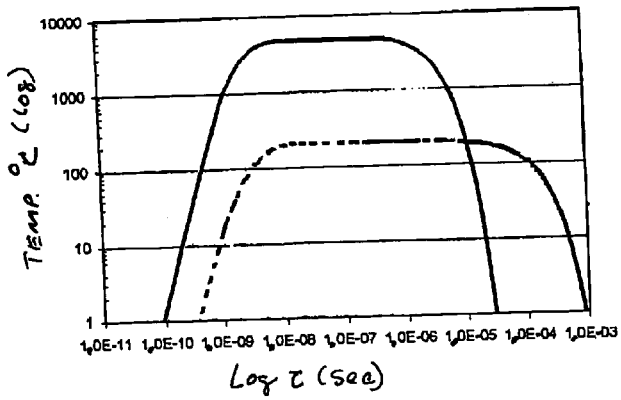
FIG. 2 is a graph with results thereof.

In FIG. 2 I have shown a graph in which temperature of the heating element has been plotted in degrees C. along the ordinate in a log scale against the time t in seconds plotted along the abscissa also in a log scale. The continuous lines represents the prior art heating element and the broken line the new heating element.

Taking into consideration the thermal conductivity of the individual material, similar values are obtained by simulation since the process involved is close to adiabatic.

Upon application of a transient pulse to the heating element in accordance with the USCAR standard, the tests show similar results, namely a destruction of the prior art heating element.

I claim:

1. A heating element for igniting a pyrotechnic charge comprising a base body, a structured strip shaped resistance layer on said base body, and contact fields overlapping said resistance layer at ends thereof for applying a current pulse to the heating element, the heating element having a mass of $1.0\times10^{-9}$ kg to $4.0\times10^{-9}$ kg, a specific resistance of $1\times10^{6}$ Ωm to $2\times10^{-6}$ Ωm, a specific heat capacity of 100 W/(kg.K) to 400 W/(kg·K), and a cross sectional area of $3.5\times10^{-10}$ $m^2$ to $7.0\times10^{-10}$ $m^2$, the resistance layer being composed of a sintered Ag/Pd resistance paste or a sintered Ag/Au/Pd resistance paste containing 30 to 50 mass % Ag and 35 to 50 mass % Pd, or a sintered Pt/W resistance paste containing 70 to 90 mass % Pt and 5 to 20 mass % W, the base body being composed of a high-temperature-resistant glass or glass-ceramic or ceramic with a thermal conductivity of at most 2 W/(m·K), and the contact fields being composed of sintered AgPd or AgPt thick-layer conductor paste with Pd or Pt proportions between 1 and 10 mass %.

2. A heating element for igniting a pyrotechnic charge comprising a base body, a structured strip shaped resistance layer on said base body, and contact fields overlapping said resistance layer at ends thereof for applying a current pulse to the heating element, the heating element having a mass of $1.0\times10^{-9}$ kg to 4.0×10–9 kg, a specific resistance of $1\times10^{-6}$ Ω m to $2\times10^{-6}$ Ω m, a specific heat capacity of 100 W/(kg.K) to 400 w/(kg·K), and a cross sectional area of $3.5\times10^{-10}$ $m^2$ to $7.0\times10^{-10}$ $m^2$, the resistance layer being composed of a sintered Ag/Pd resistance paste or a sintered Ag/Au/Pd resistance paste containing 30 to 50 mass % Ag and 35 to 50 mass % Pd, or a sintered Pt/W resistance paste containing 70 to 90 mass % Pt and 5 to 20 mass % W, the base body being composed of a high-temperature-resistant glass or glass-ceramic or ceramic with a thermal conductivity of at most 3 W/(m·K), a heat barrier being applied to said base body which is comprised of a glass or glass-ceramic layer of a thickness of 20 to 80 μm and a thermal conductivity of at most 1.5 W/(m·K), and the contact fields being composed of sintered AgPd or AgPt thick-layer conductor paste with Pd or Pt proportions between 1 and 10 mass %.

* * * * *